US006269511B1

(12) United States Patent
Andreas et al.

(10) Patent No.: US 6,269,511 B1
(45) Date of Patent: Aug. 7, 2001

(54) SURFACE CLEANING APPARATUS

(75) Inventors: Michael T. Andreas; Michael A. Walker, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/679,806

(22) Filed: Oct. 4, 2000

Related U.S. Application Data

(62) Division of application No. 09/141,384, filed on Aug. 27, 1998.

(51) Int. Cl.[7] ..... B08B 3/12; B08B 1/04
(52) U.S. Cl. ..... 15/77; 15/88.3; 134/902
(58) Field of Search ..... 15/21.1, 77, 88.2, 15/88.3; 134/902

(56) References Cited

U.S. PATENT DOCUMENTS

| | | | | |
|---|---|---|---|---|
| 3,748,677 | * | 7/1973 | Frank et al. | 15/88.3 |
| 3,893,869 | | 7/1975 | Mayer et al. | 134/86 |
| 3,970,471 | | 7/1976 | Bankes et al. | 134/6 |
| 4,804,007 | | 2/1989 | Bran | 134/184 |
| 4,869,278 | | 9/1989 | Bran | 134/184 |
| 4,998,549 | | 3/1991 | Bran | 134/184 |
| 5,037,481 | | 8/1991 | Bran | 134/1 |
| 5,081,733 | * | 1/1992 | Kudo | 15/77 |
| 5,122,170 | | 6/1992 | Satoh et al. | 96/134 |
| 5,181,985 | | 1/1993 | Lampert et al. | 438/748 |
| 5,311,634 | | 5/1994 | Andros | 15/97.1 |
| 5,317,778 | * | 6/1994 | Kudo et al. | 15/88.3 |
| 5,365,960 | | 11/1994 | Bran | 134/184 |
| 5,368,054 | | 11/1994 | Koretsky et al. | 134/153 |
| 5,427,622 | | 6/1995 | Stanasolovich et al. | 134/1 |
| 5,442,828 | | 8/1995 | Lutz | 15/88.3 |
| 5,451,267 | | 9/1995 | Stadler et al. | 134/30 |
| 5,468,302 | | 11/1995 | Thietje | 134/1 |
| 5,475,889 | | 12/1995 | Thrasher et al. | 15/88.3 |
| 5,485,644 | * | 1/1996 | Shinbara et al. | 15/21.1 |
| 5,492,594 | | 2/1996 | Burke et al. | 438/14 |
| 5,511,569 | * | 4/1996 | Mukogawa | 134/902 X |
| 5,529,638 | | 6/1996 | Lutz | 134/6 |
| 5,533,540 | | 7/1996 | Stanasolovich et al. | 134/155 |
| 5,534,076 | | 7/1996 | Bran | 134/1 |
| 5,555,177 | | 9/1996 | Simmons | 700/468.28 |

(List continued on next page.)

FOREIGN PATENT DOCUMENTS

| | | |
|---|---|---|
| 385536 | 9/1990 | (EP) . |
| 0281733 | 11/1990 | (JP) . |

OTHER PUBLICATIONS

Handbook of Semiconductor Wafer Cleaning Technology, Noyes Publications, pp. 141–142 (1993).

* cited by examiner

*Primary Examiner*—Mark Spisich
(74) *Attorney, Agent, or Firm*—Kirkpatrick & Lockhart LLP

(57) ABSTRACT

Apparatuses and methods are disclosed for submerged cleaning of substrates and the like. The apparatus includes a container holding a bath of cleaning fluid and, within the container, the combination of a submerged brush scrubber, submerged megasonic transducer and Marangoni drying devices. In operation, at least a portion of a substrate is submerged in the bath of cleaning fluid where its surfaces are contacted by one or more brush scrubbers while beams produced by megasonic transducers are directed parallel to the surface of the substrate along the surface of the substrate. The substrate is removed from the bath of cleaning fluid and rinsed with rinse water. A Marangoni flow is induced on the surface of the substrate and the substrate is allowed to dry through one or more means of drying, thereby rendering the substrate free from particulate contamination and dried of any residual fluid from the cleaning process.

57 Claims, 3 Drawing Sheets

U.S. PATENT DOCUMENTS

| | | | | |
|---|---|---|---|---|
| 5,558,568 | | 9/1996 | Talieh et al. | 451/303 |
| 5,566,466 | | 10/1996 | Hearne | 34/58 |
| 5,569,330 | | 10/1996 | Schild et al. | 134/1 |
| 5,571,044 | | 11/1996 | Bolandi et al. | 451/385 |
| 5,571,337 | | 11/1996 | Mohindra et al. | 134/25.4 |
| 5,575,707 | | 11/1996 | Talieh et al. | 451/173 |
| 5,601,655 | | 2/1997 | Bok et al. | 134/1 |
| 5,624,501 | * | 4/1997 | Gill, Jr. | 15/88.2 X |
| 5,634,978 | | 6/1997 | Mohindra et al. | 134/2 |
| 5,650,196 | | 7/1997 | Mühlfriedel et al. | 427/240 |
| 5,653,045 | | 8/1997 | Ferrell | 34/341 |
| 5,660,642 | | 8/1997 | Britten | 134/30 |
| 5,789,359 | | 8/1998 | Shimozawa et al. | 510/175 |
| 5,870,792 | | 2/1999 | Shurtliff | 15/102 |
| 5,890,251 | | 4/1999 | Terui | 15/88.2 |
| 5,933,902 | | 8/1999 | Frey | 15/102 |
| 5,975,094 | | 11/1999 | Shurtliff | 134/1.3 |
| 6,006,391 | | 12/1999 | Shurtliff et al. | 15/102 |
| 6,012,192 | | 11/2000 | Sawada et al. | 15/77 |
| 6,012,193 | | 1/2000 | Inoue et al. | 15/77 |
| 6,070,284 | * | 6/2000 | Garcia et al. | 15/77 X |
| 6,112,355 | * | 9/2000 | Tsuchida et al. | 15/77 |

SURFACE CLEANING APPARATUS

CROSS REFERENCE TO RELATED APPLICATIONS

This application is a division of co-pending application Ser. No. 09/141,384, filed Aug. 27, 1998.

STATEMENT REGARDING FEDERALLY SPONSORED RESEARCH OR DEVELOPMENT

Not Applicable

BACKGROUND OF THE INVENTION

The present invention is directed generally to cleaning a surface and, more particularly, to cleaning the surface of a semiconductor substrate following a chemical, mechanical, or chemical mechanical polishing of the substrate surface.

Integrated circuits are typically constructed by depositing layers of various materials to form circuit components on a wafer shaped semiconductor substrate. The formation of the circuit components in each layer generally produces a rough, or nonplanar, topography on the surface of the wafer. A rough surface on an underlying layer increases the likelihood of a defect occurring in subsequently deposited layers that can result in flawed or improperly performing circuitry. Thus, the efficient production of integrated circuits depends, in part, on the ability to produce smooth, or planarized, surfaces on which subsequent circuitry can be precisely deposited.

A smooth surface on the layers is generally provided by performing a planarization process. There are numerous processes used to planarize a surface, which are generally classified in the art as chemical planarization (such as etching), mechanical planarizing, and/or chemical-mechanical planarizing.

While each of the planarization processes generally provides for a more smooth surface, residual chemicals and/or particles may remain on the surface following the process. The residual chemicals and particles also must be removed to prevent defect formation in subsequent layers. Such defects may result either physically from the presence of particles or chemically via the interaction of the residual chemicals or particles with the composition of the subsequently deposited layer.

Post-planarization cleaning of the surface is often performed using various methods depending upon the composition of the layer and any residual chemicals and particles that may be present on the layer. The cleaning methods are generally wet cleaning procedures that include chemical cleaning, mechanical scrubbing and other surface agitation techniques.

For example, some cleaning methods are purely chemical or mechanical, such as those described in U.S. Pat. No. 5,181,985 and Japanese Patent Abstract Publication No. 02-281,733, respectively. As might be expected, these methods are generally more suitable for the removal of either residual chemicals or particles, respectively. Other methods, such as those described in U.S. Pat. Nos. 5,475,889, 5,442,828, 5,529,638, and 5,555,177 employ mechanical brush scrubbers that are used to brush particles from the surface, while liquid jet sprays are used to wet the surface, and possibly dislodge particles, with deionized water and/or cleaning solutions. While many of these methods provide both chemical and mechanical cleaning of the surfaces, the cleaning results derived from the methods are subject to variation due to uneven chemical distribution on the surface of the substrate which contributes to varying mechanical cleaning effectiveness and the potential for uneven drying of the surface subsequent to cleaning.

Still other methods rely on other forms of agitation to remove the residual chemicals or particles. For example, U.S. Pat. No. 5,451,267 discloses an apparatus in which a cleaning solution is agitated by bubbling a gas through the cleaning vessel to produce liquid flow past the surface to be cleaned. U.S. Pat. Nos. 3,893,869, 4,804,007, 4,869,278, 4,998,549, 5,037,481, 5,365,960, 5,368,054, 5,427,622, 5,533,540, and 5,534,076 disclose cleaning systems in which cleaning solutions and surfaces are acoustically agitated. The efficiency of these agitation methods depends upon the effectiveness of the flowing liquid or the acoustic energy at dislodging particles from the surface. It is expected that the effectiveness of the methods will depend upon the composition of the particle and the layer, as well as the particle sizes and surface affinity. It is therefore difficult to provide an effective cleaning procedure given the expected variations in residual chemicals and particle distributions during production processing of semiconductor substrates.

Following wet cleaning procedures, as the fluid on the surface of the substrate evaporates, particles and other contaminants contained in the residual cleaning fluid may settle on the surface to form water marks. Therefore, it is desirable to dry the surface following a wet cleaning procedure in a manner that minimizes evaporation and the resulting formation of water marks. A number of methods such as those described in U.S. Pat. No. 5,660,642, 5,569,330, 5,653,045, 5,634,978, 5,601,655, and 5,571,337, utilize the formation of a Marangoni flow to decrease the surface tension of fluid on the surface, thereby facilitating the removal of the water from the surface prior to evaporation.

As is evident from the aforementioned discussion, a number of difficulties remain with present cleaning methods that need to be overcome to provide an effective cleaning method for surfaces. The present invention serves to provide methods and apparatuses for cleaning surfaces, in particular, the surfaces of semiconductor substrate layers.

BRIEF SUMMARY OF THE INVENTION

The present invention is directed to surface cleaning and drying methods and apparatuses that provide for improved cleanliness of surfaces. The apparatus generally includes a chamber suitable for retaining cleaning fluids and receiving at least one substrate having a surface that is to be cleaned. The chamber preferably includes mechanical scrubbers, generally in the form of cylindrical brushes or pads, submerged in the cleaning fluids within the chamber and positioned to contact and scrub at least one substrate submerged in the cleaning fluid. In a preferred embodiment, the substrates are fully submerged during the scrubbing, although the portion not being contacted by the scrubber need not be submerged. The chamber may further include at least one discharge for spraying a fluid, such as deionized water, onto the substrate to rinse the residual cleaning fluid from the substrate. In a preferred embodiment, the discharge is located within the same chamber as the mechanical scrubbers. The chamber may further include a mechanism for drying the substrate once the cleaning and rinsing processes have been completed. In a preferred embodiment, the drying mechanism utilizes the formation of a Marangoni flow to remove fluid from the surface of the substrate before it evaporates. Also in a preferred embodiment, the drying apparatus is included in the same chamber as the scrubbing apparatus, although in alternative embodiments, separate chambers may be used for one or more of the individual scrubbing, rinsing, and drying apparatus.

The apparatus also preferably includes a cleaning fluid recirculation loop that is used to remove residual chemicals, particles, and other contaminants from the cleaning fluid and to replenish the cleaning fluid. In this manner, the substrate surfaces can be more uniformly contacted by chemical cleaning fluids and the composition of the cleaning fluid can be more precisely controlled. In the embodiment in which the cleaning, rinsing, and drying processes are performed within the same chamber, the recirculation loop is additionally used to drain the cleaning and rinsing fluids from the chamber so that the rinsing and drying process may be initiated.

An embodiment of the mechanical scrubbing apparatus may additionally include megasonic enhancement to the mechanical scrubbing process. Megasonic cleaning is known in the art and involves generating a megasonic signal (0.2–5 MHz) within the bath of cleaning fluid and directing it substantially parallel to the submerged surface of the substrate to be cleaned. The megasonic signal causes the cleaning fluid through which the signal passes to become agitated. The action of the fluid agitation against the surface of the substrate causes minute particles to become dislodged from the substrate. Such particles are generally tenaciously adhered to the substrate and would not otherwise be readily dislodged by mechanical scrubbing methods without an increased potential for damage to the substrate caused by increased direct contact to the surface of the substrate brought on by additional brushing or scrubbing. Mechanical scrubbing with megasonic enhancement thus provides a benefit over purely mechanical methods of brushing or scrubbing in that it serves to remove additional particulate matter from the surface of the substrate without contacting the substrate. As such, the potential for damage to the substrate from additional brushing or scrubbing is also removed.

In an embodiment of the drying method, the cleaning fluid preferentially produces a surface composition that is hydrophilic. The formation of such a hydrophilic surface thus aides in the evacuation of fluid from the surface of the substrate, thereby reducing the potential for deposition of contaminants at the interface of hydrophilic and hydrophobic portions of the surface. In a further aspect of the drying method, after the cleaning process, the surface of the substrate is flushed with a rinsing fluid to remove the cleaning fluid from the surface of the substrate. However, after the rinse a thin film of fluid often remains on the surface of the substrate. If the film is allowed to evaporate on the surface of the substrate, impurities held by the fluid will be deposited on the surface of the substrate. Drying methods such as gravity flow and spin drying, are thus used to evacuate the fluid from the surface of the substrate before it is allowed to evaporate. However, such methods alone have proven ineffective in removing sufficient quantities of fluid from the surface of the substrate prior to evaporation. The present invention thus calls for the formation of a surface tension gradient, or Marangoni gradient, on the surface of the substrate to enable the rapid removal of the film of fluid remaining from the surface of the substrate. Such a Marangoni drying process is achieved by the passive introduction (by natural evaporation and diffusion of vapors) of surface tension-reducing volatile organic compounds, in the vicinity of the film of fluid adhering to the surface of the substrate. The compounds will diffuse into the film of fluid, resulting in surface tension gradients (Marangoni gradients) and causing the surface tension of the film of fluid to decrease. After reducing the surface tension, the film of fluid can be then be more easily removed from the surface of the substrate by way of gravity flow, spin drying, or other removal techniques as are known in the art. Marangoni drying thus has the benefit of expediting the removal of the film of water from the surface of the substrate while avoiding the potentially deleterious effects brought on by using heat, air flow, or direct physical contact to dry the surface of the substrate. Marangoni drying also has the additional benefit of inducing the film of water to leave the surface of the substrate without allowing it to evaporate while on the surface of the substrate and deposit any impurities contained therein on the surface of the substrate.

Accordingly, the present invention overcomes the aforementioned problems to provide apparatuses and methods that provide for improved cleanliness of surfaces, such as semiconductor wafer substrates. These advantages and others will become apparent from the following detailed description of the invention.

BRIEF DESCRIPTION OF THE DRAWINGS

Preferred embodiments of the invention will now be described, by way of example only, with reference to the accompanying Figures wherein like members bear like reference numerals and wherein.

DETAILED DESCRIPTION OF THE INVENTION

Figure 1:
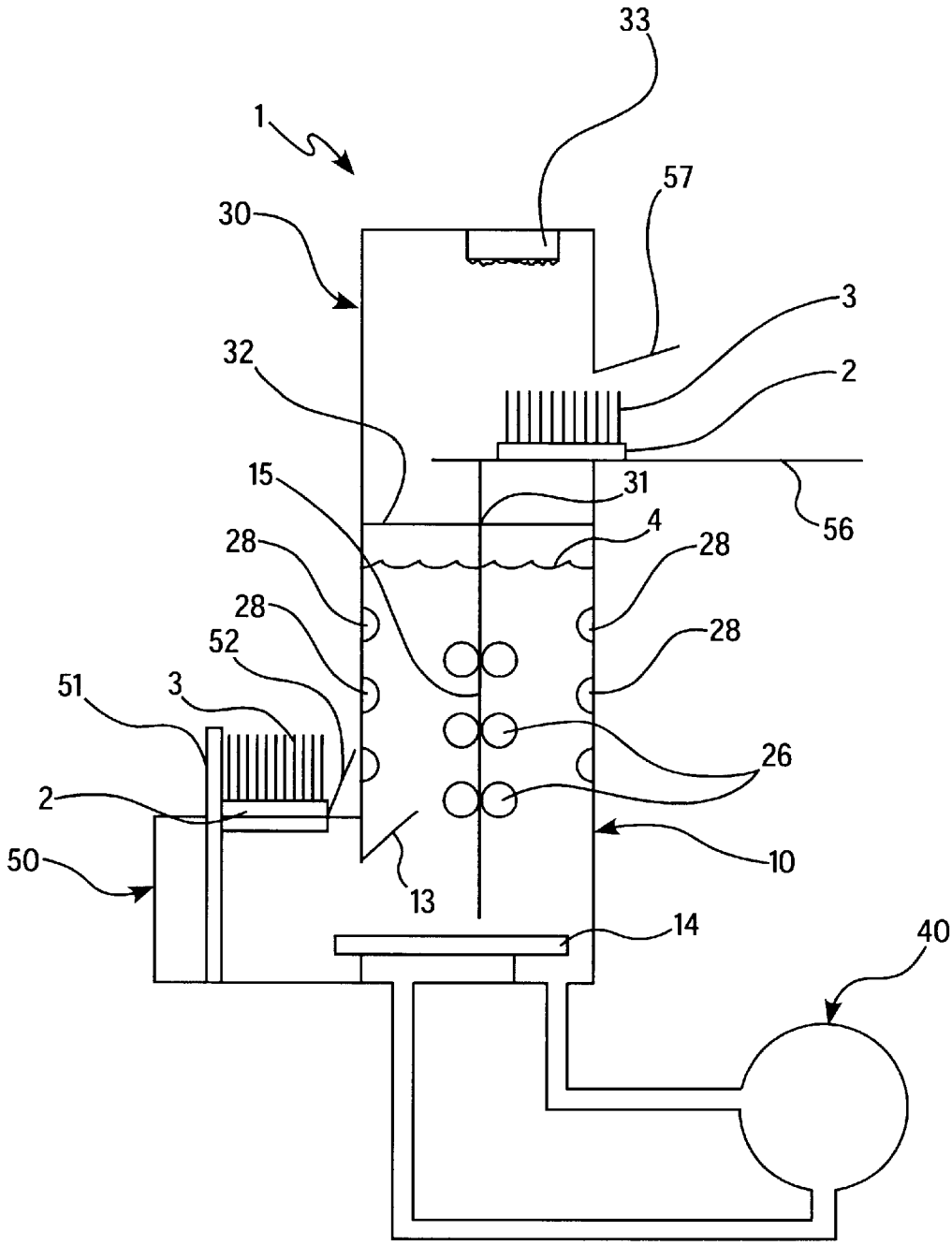
FIG. 1 is a semi-schematic view of an embodiment of the apparatus of the present invention.

The operation of the submerged cleaning apparatus 1 will be described generally with reference to the drawings for the purpose of illustrating the present preferred embodiments of the invention only and not for purposes of limiting the same. Referring now to the drawings, the figures show a submerged cleaning apparatus for mechanically cleaning semiconductor substrates. More particularly, and with reference to FIG. 1, the submerged scrubber is shown generally as 1. The preferred construction of the submerged cleaning apparatus 1 of the present invention, as shown in FIG. 1, includes a submersion chamber 10 and a drying chamber 30. Preferably, a recirculation system 40 and a loading area 50 are also provided.

In the present embodiment, the drying chamber 30, is preferably located adjacent to and above the submersion chamber 10. The submersion and drying chambers 10 and 30, respectively, are separated by a wall 32. The wall 32 thus forms the ceiling of the submersion chamber 10 and the floor of the drying chamber 30 and thereby serves to prevent communication of fluid 4 between the submersion chamber 10 to the drying chamber 30. Wafers 3 to be cleaned enter the apparatus on wafer trays 2 at a loading area 50, located on the side of the apparatus 1 at the lower end of the submersion chamber 10. Upon entering the loading area 50, the door 52 to the loading area 50 is closed and the seal 13 separating the loading area 50 from the submersion chamber 10 is opened. As such, the wafers 3 are submerged in the bath of cleaning fluid 4. The wafers 3 move into the submersion chamber 10 on wafer tray conveyor 14. Upon entering the submersion chamber 10, the individual wafers 3 are transferred by suitable handling apparatus from the wafer tray 2 to a wafer conveyor 15 which carries the individual wafers 3 through a series of submerged mechanical and megasonic cleaning apparatus 26 and 28, respectively. After leaving the bath of cleaning fluid 4, the wafers 3 enter a drying chamber 30 and are transferred back to a wafer tray 2. After drying operations in the drying chamber 30, wafers 3 exit the apparatus 1 at a door 57 located on the side of the drying chamber 30 at the upper end of the apparatus 1.

The submersion chamber 10 provides a contained environment suitable for holding a bath of chemical cleaning fluid 4 therein. The composition of the bath of chemical cleaning fluid 4 is dependent upon the surface to be cleaned and the contaminants to be removed. However, one preferred chemistry is dilute TMAH. The submersion chamber 10 is preferably constructed as a tank that is impervious to the chemicals contained in the bath of cleaning fluid 4. Preferably, the submersion chamber 10 is constructed from polytetrafluoroethylene (PTFE). A wafer tray conveyor 14 is positioned within the chamber 10 along the floor for moving wafer trays 2 containing wafers 3 from the loading area 50 into the submersion chamber 10. Adjacent to the conveyor 14, a set of opposing parallel rail members 16 and 18 define the path of wafer conveyor 15. Preferably, wafer conveyor 15 is oriented perpendicular to the tray conveyor 14 and is positioned such that individual wafers 3 may be drawn directly from the wafer tray 2 into the wafer conveyor 15.

Figure 2:
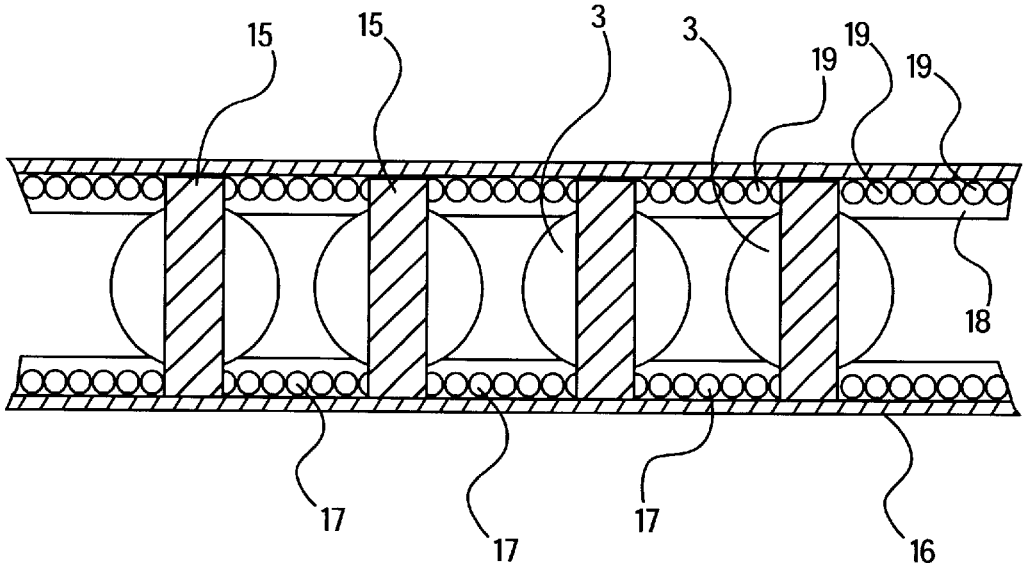
FIG. 2 is a cut-away view of the wafer conveyor of the embodiment shown in FIG. 1.
Figure 3:
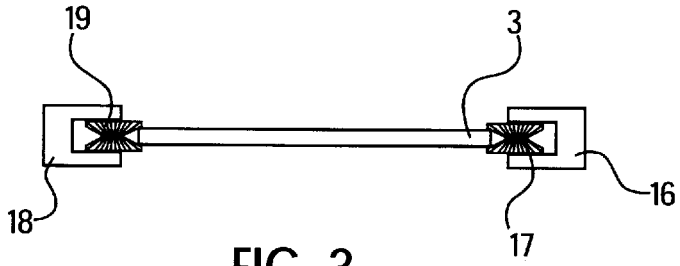
FIG. 3 is a cut-away side view of the wafer conveyor of the embodiment of FIG. 1.
Figure 4:
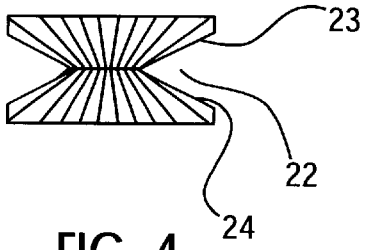
FIG. 4 is a side view of the roller of the embodiment of FIG. 1.

As shown in particular in FIGS. 2 and 3, the wafer conveyor 15 includes two generally parallel rail members 16 and 18 that run along the length of the submersion container 10. Each rail member 16 and 18, has a set of rollers 17 and 19, respectively, mounted thereon. The rail members 16 and 18 are preferably U-shaped in cross-section. However, it will be appreciated that additional cross-sectional configurations resembling, for example "C" or "V" are also suitable for the design of the rail members 16 and 18. The opposing sets of rollers 17 and 19 are rotatably connected along the length of the inner edge of each of the rail members 16 and 18, respectively. As shown in particular in FIG. 4, each of the rollers 17 and 19 preferably has a notch 22 therein. The notch 22 in each of the rollers 17 and 19 preferably has oppositely angled walls 23 and 24 such that the notch 22 is widest around the circumference of each roller 17 and 19 and tapers toward the center axis of each roller 17 and 19. In operation, the two opposing sets of rollers 17 and 19 are preferably spaced from each other by a distance that is less than the diameter of one wafer 3. Thus, as shown in particular in FIG. 3, wafers 3 are held between the opposing sets of rollers 17 and 19, with minimal contact to the surface of the wafer 3 by the walls of the notch 23 and 24. When the sets of rollers 17 and 19 are driven by a motor (not shown), the wafers 3 held therebetween will be transported along the length of the wafer conveyor 15. It will further be appreciated that in additional embodiments, alternative designs such as motorized belts (not pictured) or individual wafer trays (not pictured) could also be used to hold the individual wafers 3 within the wafer conveyor 15.

Mechanical brush scrubbers 26 are positioned to contact both surfaces of the wafer 3 as it is moved along the length of the wafer conveyor 15. Such brushes 26 are well known in the art and are manufactured and sold, for example, by Syntak, Incorporated.

The brushes 26 are typically cylindrical and have surfaces (not shown) populated with a plurality of protrusions. The geometry of the protrusions may be that of circular knobs, linear ridges, or any other pattern known in the art. In operation, when the cylindrical brush 26 is rotated, the protrusions physically contact the surface of the wafer 3 and work to remove impurities deposited thereon. Preferably, the cylindrical brushes 26 are positioned on either side of the wafer conveyor 15 such that both sides of the wafer 3 may be cleaned simultaneously.

Preferably the mechanical brush scrubbers 26 are augmented by megasonic cleaning apparatuses are as is known in the art. The megasonic enhancement of the mechanical brushes 26 includes a series of transducers 28 positioned below the surface of the chemical bath 4 within the submersion chamber 10. The transducers 28 are oriented relative to the surface of the wafers 3 held in the wafer conveyor 15 such that they direct a high frequency (megasonic) signal through the bath of cleaning fluid 4 substantially parallel to the surfaces of the submerged wafers 3. Preferably, the frequency of the signal emitted by the transducers 28 will be made to vary between 0.2 and 5 MHz. In operation, the high frequency of the signal causes the fluid 4 through which the path of the signal passes to become agitated. In particular, the fluid 4 directly surrounding the surfaces of the wafers 3 is agitated. The action of the agitated fluid 4 against the surface of the wafer 3 serves to enhance the removal of minute particles from the surface of the wafer 3, that would otherwise require additional mechanical brush scrubbers 26 to remove.

The drying chamber 30 is located above the submersion chamber 10 and may be separated therefrom by a wall 32. As such, the wall 32 prevents the chemical bath 4 contained in the submersion chamber 10 from entering the drying chamber 30. Preferably, the wall 32 contains gap 31 therein through which the wafer conveyor 15 passes from the submersion chamber 10 to the drying chamber 30. The gap 31 thus enables the wall 32 to inhibit the interaction of the atmospheres of the two chambers 10 and 30, while allowing the wafers 3 held within the wafer conveyor 15 to pass from the submersion chamber 10 into the drying chamber 30. Within the drying chamber 30, the wafer conveyor 15 meets a second wafer tray conveyor 56. The conveyor 56 is designed to hold a wafer tray 2 thereon and to position the tray 2 such that wafers 3 may be transferred directly from the wafer conveyor 15 into the tray 2. The drying chamber 30 further includes a series of spray nozzles 33. The spray nozzles 33 are supplied with a rinsing fluid and are positioned to direct a stream of the rinsing fluid onto the surfaces of the wafers 3 to flush the surface of the wafers 3 and to remove any residual fluids remaining on the surface of the wafers 3 from the cleaning fluid 4 from the surface of the wafer 3. Preferably, the composition of the rinsing fluid will include de-ionized water. The nozzles 33 are also supplied with surface tension reducing compounds and are equipped to flush the surface of the wafers 3 with the surface tension-reducing compounds to induce surface tension gradients (Marangoni gradients) between the surface of the wafer 3 and any fluid remaining on the surface of the wafer 3 after the rinse process has been completed. The resulting Marangoni flow is known in the art and is commonly used to remove fluid from surfaces prior to the evaporation of that fluid. In operation, a stream of fluid from the nozzles 33 is directed at the surfaces of the wafers 3. The stream diffuses into any fluid remaining on the surface of the wafers 3, resulting in a Marangoni gradient and causing the surface tension of the fluid already on the surfaces of the wafers 3 to decrease. The reduced surface tension of the fluid on the surfaces of the wafer 3 thus enables the fluid to be more easily removed from the surfaces of the wafers 3 by means of gravity flow, spin drying, or other like drying techniques known in the art. Preferably, the surface tension-reducing compound sprayed by the nozzles 33 onto the surfaces of the wafers 3 will include volatile organic compounds such as isopropyl alcohol. However, it will be understood that additional compounds having similar surface tension reducing properties such as ethanol may also be used.

The drying chamber 30 is preferably provided with a door 57 through which the wafer tray conveyor 56 travels. When the door 57 is closed, the environment within the drying chamber 30 is unable to communicate with the environment outside the chamber 30. However, when the door 57 is opened, an empty wafer tray 2 may be inserted into the chamber 30, or a wafer tray 2 with wafers 3 therein removed from the chamber 30.

A loading chamber 50 is also preferably provided from which a wafer tray 2 containing wafers 3 to be cleaned may be inserted into the apparatus 1. In operation, a wafer tray 2 containing wafers 3 is placed onto a wafer elevator 51. The elevator 51 lowers the wafer tray 2 into the loading chamber 50. Once within the loading chamber 50, the door 52 of the loading chamber 50 is closed, sealing the loading chamber 50 from the outside atmosphere and the door 13 linking the loading chamber 50 and the submersion chamber 10 is opened allowing the inside of the loading chamber 50 to communicate with the inside of the submersion chamber 14. The tray 2 is then moved 53 to the submersion chamber 10 on conveyor 14 and positioned to load the wafers 3 contained thereon into the wafer conveyor 15.

A recirculation system 40 is preferably provided for replenishing the volume of chemical cleaning fluid 4 in the submersion chamber 10. Such a recirculation system 40 is known in the art and is capable of removing residual chemicals, particles, and other contaminants from the chemical cleaning fluid 4 and returning the cleaned fluid 4 to the submersion chamber 10. The recirculation system 40 is also used to drain and fill the submersion chamber 10 and the loading chamber 50 with cleaning fluid 4 as is needed to facilitate the submerged cleaning process.

Figure 5:
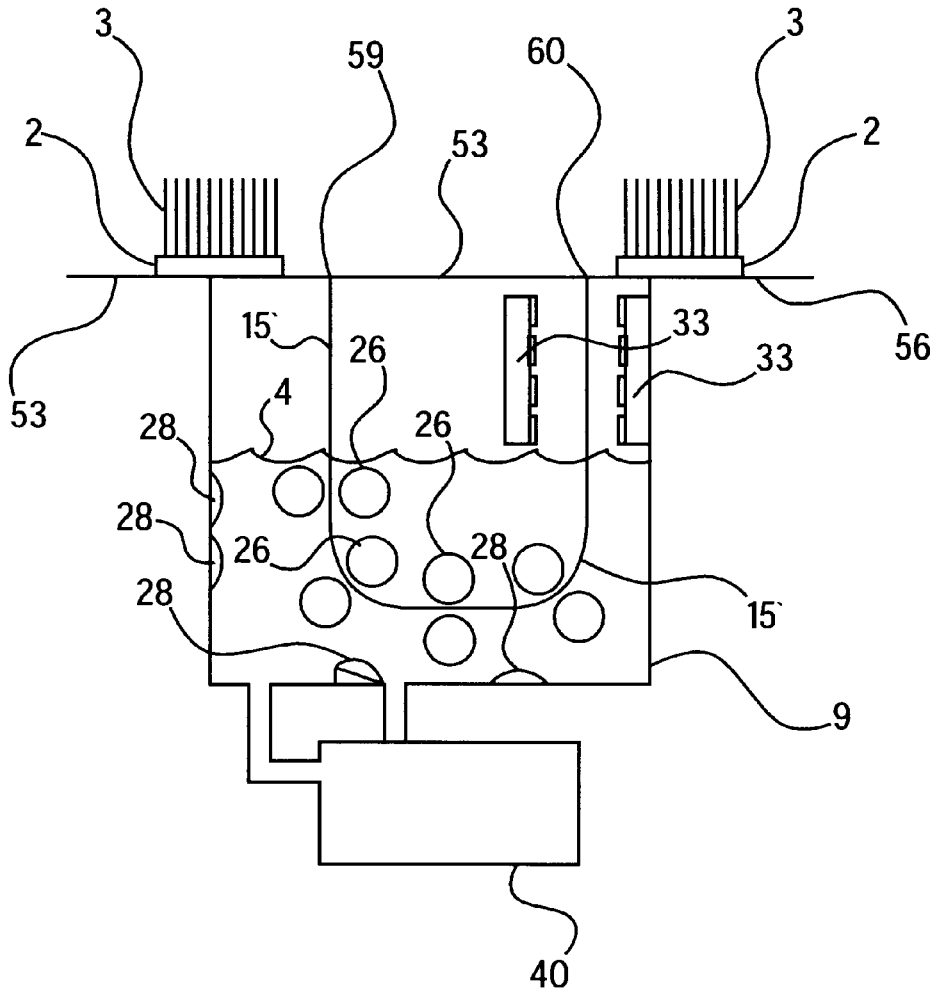
FIG. 5 is a semi-schematic view of another embodiment of the apparatus of the present invention.

In a further embodiment of the present invention shown in FIG. 5, the submerged mechanical scrubbing and drying operations are conducted within a single container 9. As such, the container 9 performs the function of the submersion chamber 10 and the drying chamber 30 described herein with regard to previous embodiments and like embodiments will be similarly numbered.

As seen in FIG. 5, the container 9 is adapted to hold a bath of cleaning fluid 4 therein and to remain impervious to the effects of the chemicals that make up the bath of cleaning fluid 4 for prolonged periods of time. A wafer conveyor 15' is contained within the container 9. The conveyor 15' follows a generally U-shaped path through the container 9. As such, the ends 59 and 60 of the conveyor 15' are above the surface of the bath of cleaning fluid 4, while the remainder of the conveyor 15' remains submerged within the bath of cleaning fluid 4. The general design and operation of the wafer conveyor 15' is otherwise identical to that of other embodiments of the wafer conveyor 15 described herein above. As is the case with previous embodiments, scrubber brushes 26 are positioned beneath the surface of the bath of cleaning fluid 4 along the path of the conveyor 15'. The design and operation of the brushes 26 are otherwise identical to that of other embodiments of the brushes 26 described herein above. As such, the brushes 26 contact and clean the surface of the wafers 3 contained in the conveyor 15'. Adjacent to the brushes 26 lies a series of one or more transducers 28. The transducers 28 are oriented to direct beams of megasonic energy parallel to the surfaces of the wafers 3 held within the wafer conveyor 15' as the wafers pass the brushes 26. The design and operation of the transducers 28 are otherwise equivalent to that of the transducers 28 described previously herein above. Adjacent to the portion of the conveyor 15' lying after the brushes 26 and above the surface of the bath of cleaning fluid 4 are a series of spray nozzles 33. The design and operation of the nozzles 33 are otherwise identical to those of other embodiments of the nozzles 33 described herein above.

Wafer tray conveyors 53 and 56 may also be provided for use in loading and unloading trays 2 of wafers 3 from the container 9. Preferably, the loading conveyor 53 intersects one end 59 of the wafer conveyor 15'. When a tray 2 of wafers 3 is positioned on the conveyor 53 above the end 59 of the wafer conveyor 15', the wafers 3 may be fed directly into the wafer conveyor 15'. Similarly, an unloading conveyor 56 intersects the end 60 of the wafer conveyor 15'. When a tray 2 of wafers 3 is positioned on the conveyor 56 above the end 60 of the wafer conveyor 15', the wafers may be fed directly from the wafer conveyor 15' into the wafer tray 2. Thus, after being loaded into the container 9 at 59, the wafer tray 2 may be advanced along the loading conveyor 53, onto unloading conveyor 56, and positioned above 60 to receive a load of cleaned wafers 3 being unloaded from container 9.

The present embodiment of the invention also preferably includes a cleaning fluid 4 recirculation system 40 for recirculating and replenishing the cleaning fluid 4 in the container 9 as is needed to facilitate the cleaning process, the design and operation of which is identical to those embodiments described previously herein above. The design and operation of the recirculation system 40 is otherwise identical to that of the recirculation system 40 previously described herein with regard to other embodiments of the present invention.

In operation, a wafer tray 2 with wafers 3 therein is positioned on the loading conveyor 53 and moved to the end 59 of the wafer conveyor 15'. The wafers 3 are loaded from the wafer tray 2 onto the wafer conveyor 15'. The wafer conveyor 15' transports the wafers 3 into the bath of cleaning fluid 4. Beneath the surface of the bath of cleaning fluid 4, the wafers 3 are moved along the wafer conveyor 15' past a series of the rotating cylindrical brushes 26. The surfaces of the wafers 3 are contacted and cleaned by the brushes 26. In conjunction with the brushes 26, transducers 28 direct megasonic signals parallel to the surfaces of the wafers 3 so as to create agitation in the fluid 4 along the surface of the wafers 3 and to remove impurities therefrom. After passing through the scrub brushes 26 and transducers 28, the wafer conveyor 15' emerges from the bath of cleaning solution 4 and passes a series of spray nozzles 33. As with previous embodiments, the nozzles 33 first flush the surface of the wafers 3 with a rinsing solution to remove the residual chemical cleaning solution 4 from the surface of the wafers 3. The nozzles 33 then spray the surface of the wafers 3 with a surface tension-reducing compound to induce a Marangoni flow on the surface of the wafers 3 to dry the surfaces of the wafers 3 of any residual fluid or chemicals before those chemicals are allowed to evaporate on the surface of the wafer 3. The wafers 3 are then unloaded directly into a waiting wafer tray 2 sitting atop the unloading conveyor 56 at end 60 of the wafer conveyor 15'.

Those of ordinary skill in the art will appreciate that a number of modifications and variations that can be made to specific aspects of the method and apparatus of the present invention without departing from the scope of the present invention. Such modifications and variations are intended to be covered by the foregoing specification and the following claims.

What is claimed is:

1. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container; and a sonic transducer positioned relative to the surface of the substrate.

2. The cleaning apparatus of claim 1, wherein the transducer is an ultrasonic transducer adapted to propagate a beam of ultrasonic energy in a direction substantially parallel to the submerged portion of the substrate within the container.

3. The cleaning apparatus of claim 2, wherein the frequency of the beam of ultrasonic energy is between 0.2 and 5 MHz.

4. The cleaning apparatus of claim 1, wherein the transducer is positioned below the surface of the bath of cleaning fluid.

5. The cleaning apparatus of claim 1, wherein the scrubber is moveable.

6. The cleaning apparatus of claim 5, wherein the movement of the scrubber includes rotational movement.

7. The cleaning apparatus of claim 1, wherein the scrubber is selected from the group consisting of a brush and a pad.

8. The cleaning apparatus of claim 1, wherein the scrubber is fully submerged in the bath of cleaning fluid.

9. The cleaning apparatus of claim 1, wherein the substrate is partially submerged in the bath of cleaning fluid.

10. The cleaning apparatus of claim 1, wherein the substrate is a semiconductor substrate.

11. The cleaning apparatus of claim 10, wherein the semiconductor substrate is a semiconductor wafer.

12. The cleaning apparatus of claim 1, wherein the container is constructed from polytetrafluoroethylene.

13. The cleaning apparatus of claim 1, further comprising a substrate conveyor.

14. The cleaning apparatus of claim 1, further comprising a spin drying device for removing fluid from the surface of the substrate.

15. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate; and a fluid rinse source positioned within the second chamber.

16. The cleaning apparatus of claim 15, wherein the fluid rinse source discharges a rinse fluid onto the substrate.

17. The cleaning apparatus of claim 16, wherein the discharging further comprises a spray nozzle.

18. The cleaning apparatus of claim 16, wherein the rinse fluid comprises deionized water.

19. The cleaning apparatus of claim 16, wherein the rinse fluid comprises a surface tension reducing compound.

20. The cleaning apparatus of claim 19, wherein the surface tension reducing compound is a volatile organic compound.

21. The cleaning apparatus of claim 20, wherein the volatile organic compound is selected from the group consisting of isopropyl alcohol and ethanol.

22. The cleaning apparatus of claim 16, wherein the cleaning fluid produces a surface composition that is hydrophilic.

23. The cleaning apparatus of claim 15, wherein the fluid from the fluid rinse source induces a lowering of the surface tension of a fluid on the surface of the substrate, resulting in a surface tension gradient.

24. The cleaning apparatus of claim 15, wherein the mechanical scrubber and the transducer are located in the first compartment of the container.

25. The cleaning apparatus of claim 15, wherein the mechanical scrubber, the transducer and the fluid rinse source are each located in the same container.

26. The cleaning apparatus of claim 15, wherein the transducer is an ultrasonic transducer adapted to propagate a beam of ultrasonic energy in a direction substantially parallel to the submerged portion of the substrate within the container.

27. The cleaning apparatus of claim 15, wherein the transducer is positioned below the surface of the bath of cleaning fluid.

28. The cleaning apparatus of claim 15, wherein the scrubber is moveable.

29. The cleaning apparatus of claim 15, herein the scrubber is fully submerged in the bath of cleaning fluid.

30. The cleaning apparatus of claim 15, further comprising a substrate conveyor.

31. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate; and a loading chamber.

32. The cleaning apparatus of claim 31, wherein the loading chamber is positioned next to the container.

33. The cleaning apparatus of claim 32, wherein the loading chamber and the container are separated by a door.

34. The cleaning apparatus of claim 31, wherein the substrate is moved from the loading chamber to the container by a conveyor.

35. The cleaning apparatus of claim 31, wherein the loading chamber further comprises an elevator.

36. The cleaning apparatus of claim 31, wherein the transducer is an ultrasonic transducer adapted to propagate a beam of ultrasonic energy in a direction substantially parallel to the submerged portion of the substrate within the container.

37. The cleaning apparatus of claim 31, wherein the transducer is positioned below the surface of the bath of cleaning fluid.

38. The cleaning apparatus of claim 31, wherein the scrubber is moveable.

39. The cleaning apparatus of claim 31, wherein the scrubber is fully submerged in the bath of cleaning fluid.

40. The cleaning apparatus of claim 31, further comprising a substrate conveyor.

41. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate; and a substrate conveyor.

42. The cleaning apparatus of claim 41, wherein the substrate conveyor further comprises generally parallel rail members.

43. The cleaning apparatus of claim 42, wherein the rail members further comprise rollers.

44. The cleaning apparatus of claim 43, wherein the rollers are driven by a motor.

45. The cleaning apparatus of claim 43, wherein the rollers are spaced from each other by a distance that is less than the diameter of the substrate.

46. The cleaning apparatus of claim 41, further comprising a substrate tray conveyor.

47. The cleaning apparatus of claim 46, wherein the substrate conveyor is positioned perpendicular to the substrate tray conveyor.

48. The cleaning apparatus of claim 41, wherein the transducer is an ultrasonic transducer adapted to propagate a beam of ultrasonic energy in a direction substantially parallel to the submerged portion of the substrate within the container.

49. The cleaning apparatus of claim 41, wherein the transducer is positioned below the surface of the bath of cleaning fluid.

50. The cleaning apparatus of claim 41, wherein the scrubber is moveable.

51. The cleaning apparatus of claim 41, wherein the scrubber is fully submerged in the bath of cleaning fluid.

52. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate;

a fluid rinse source positioned within the second chamber; and a loading chamber.

53. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate;

a fluid rinse source positioned within the second chamber; and a substrate conveyor.

54. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate;

a loading chamber; and a substrate conveyor.

55. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate;

a fluid rinse source positioned within the second chamber;

a loading chamber; and a substrate conveyor.

56. A cleaning apparatus for cleaning the surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication and separated by a wall and a gap structured and arranged to inhibit the interaction of the atmospheres of the first and second chambers and to permit the substrate to be moved therethrough from the first to the second chamber;

a mechanical scrubber positioned within the container;

a sonic transducer positioned relative to the surface of the substrate;

a fluid rinse source positioned within the second chamber;

a loading chamber;

a substrate conveyor; and a recirculation system.

57. A cleaning apparatus for cleaning a surface of a substrate with a bath of cleaning fluid, comprising:

a container having a first chamber and a second chamber, the first chamber adapted to hold the bath of cleaning fluid and a submerged portion of the substrate within the bath of cleaning fluid, wherein the first and second chambers are in communication;

means for inhibiting the interaction of the atmospheres of the first and second chambers and for permitting the substrate to be moved between the first and second chambers;

a mechanical scrubber positioned within the container; and a sonic transducer positioned relative to the surface of the substrate.

* * * * *

UNITED STATES PATENT AND TRADEMARK OFFICE

CERTIFICATE OF CORRECTION

PATENT NO. : 6,269,511 B1
DATED : August 7, 2001
INVENTOR(S) : Michael T. Andreas and Michael A. Walker It is certified that error appears in the above-identified patent and that said Letters Patent is hereby corrected as shown below:

Column 7,
Line 28, delete "53"

Signed and Sealed this

Twenty-third Day of April, 2002

*Attest:*

*Attesting Officer*

JAMES E. ROGAN
*Director of the United States Patent and Trademark Office*